United States Patent [19]

Lupton

[11] Patent Number: 4,762,371

[45] Date of Patent: Aug. 9, 1988

[54] ROAD PLANNING EQUIPMENT

[75] Inventor: William G. Lupton, North Yorkshire, England

[73] Assignee: Econ Group Limited, North Yorkshire, England

[21] Appl. No.: 660,886

[22] Filed: Oct. 15, 1984

[30] Foreign Application Priority Data

Oct. 14, 1983 [GB] United Kingdom ..... 27573

[51] Int. Cl.[4] ..... E01C 23/08

[52] U.S. Cl. ..... 299/39; 404/91

[58] Field of Search ..... 299/36, 39, 40; 404/75, 404/90, 91; 172/23, 98; 173/22, 23; 241/101.7; 37/92, 86, 189

[56] References Cited

U.S. PATENT DOCUMENTS

| | | | |
|---|---|---|---|
| 1,782,690 | 11/1930 | Kerr | 172/23 |
| 2,887,134 | 5/1959 | Bartlett | 144/2 N |
| 3,107,460 | 10/1963 | Staehlin | 299/39 |
| 3,547,492 | 4/1969 | Binger | 299/39 |
| 3,779,606 | 12/1973 | Hatcher et al. | 299/39 |
| 3,874,806 | 4/1975 | Grist et al. | 404/75 X |
| 4,346,766 | 8/1982 | Manten | 173/23 |
| 4,530,385 | 7/1985 | York | 241/101.7 X |
| 4,557,626 | 12/1985 | McKay et al. | 299/39 X |

FOREIGN PATENT DOCUMENTS

| | | | |
|---|---|---|---|
| 2302764 | 7/1974 | Fed. Rep. of Germany | 404/90 |
| 1784637 | 6/1979 | Fed. Rep. of Germany | 404/90 |
| 1590110 | 5/1970 | France . | |
| 2300173 | 9/1976 | France . | |
| 1420432 | 1/1976 | United Kingdom . | |
| 614153 | 7/1978 | U.S.S.R. | 299/39 |

*Primary Examiner*—Stephen J. Novosad
*Assistant Examiner*—Matthew Smith
*Attorney, Agent, or Firm*—Fred Philpitt

[57] ABSTRACT

The invention provides road planing equipment. A beam which lies substantially horizontally in relation to the ground carries a cutting unit for movement thereon. As the cutting unit moves along the beam, it planes the road surface to a controlled depth. The beam is supported at one end by a bracket which can move a frame transversely of the beam to move the beam laterally. The frame is supported on spaced, extensible and contractible legs. At the other end the beam is supported on a single expansible and contractible leg. Thus, the height of the beam above the ground and the angle of the beam in relation to the ground can be adjusted. The beam can be pivoted to an upwardly directed out of use position.

22 Claims, 4 Drawing Sheets

ROAD PLANNING EQUIPMENT

This invention relates to road planing equipment, which is equipment comprising a cutting means for removing to a predetermined depth, the surface of a roadway. Typically, the equipment may remove the asphalt or concrete of the roadway surface to enable working by other equipment on the substrate under the asphalt or concrete surface.

There are known several forms of road planing equipment, and known, large, motorway planing equipment comprises a substantial, wheeled or tracked chassis which in use progresses slowly over the surface to be planed. The chassis is provided with a cutter head which performs the removal of the motorway surface.

Another known type of planing equipment comprises a mobile machine with a cutting head adjacent one of the ground wheels, which wheel also controls the depth to which the cutting head cuts.

Another known arrangement comprises an attachment for connection to a digger arm of an excavator in place of the bucket, and the attachment has a guide wheel and a cutting head, the guide wheel controlling the depth of cut and the attachment being moved by the normal digger arms.

There is no relatively simple and versatile road planing equipment, capable of performing the function of removing roadway surfaces simply and efficiently, and the present invention was conceived with a view to meeting this objective.

The present invention provides a new approach to the construction of roadway planing equipment and provides several novel aspects, and in accordance with one aspect of the invention the equipment comprises a beam on which is supported a planing unit including at least one cutting head, and the planing unit is mounted so as to be movable along the beam to carry out the function of removing the roadway surface, the equipment further including means for supporting the beam or adapting the beam to be supported at least at one end at a predetermined height above the road surface for controlling the extent to which the cutter cuts the said surface.

Preferably, the beam at said one end is carried by a frame having legs which are adjustable in length, such legs having ground engaging feet and being of variable length, whereby the framework can be set to preposition the beam end. The beam may be mounted on said frame by means of a bracket which can be displaced in a direction transverse to the beam length, whereby the beam position laterally of its length may be altered, whereby the cutting head can be operated to remove an area of roadway surface by the combined movement of the cutting unit long the beam and the bodily movement of the beam transversely of its length on the said framework.

At the other end, the beam preferably has a support leg, which is also of variable length and has a ground engaging foot, so that by causing the beam to be supported by the feet of the framework and the support leg at the end of the beam, the cutter unit will travel in a predetermined path along the beam and will cut along a line parallel to the beam, regardless of the profile of the road surface under the cutter head.

At said one end, the beam is preferably pivotally connected to the bracket, so that it can be moved between an operative and substantially horizontal position, and a stored, pivoted position, in which the beam extends upwardly. The means for pivoting the beam as described may comprise a fluid pressure operated ram.

The pivoting of the beam is a novel approach in road planars, and in accordance with another aspect of the invention a road planar comprises a beam or frame for carrying a cutter unit, said beam or frame being pivoted between in use and out of use portions.

The framework may be for attachment to the rear of a tractor or other vehicle so that the beam extends rearwardly in the fore-and-aft direction of the vehicle.

The cutting unit may include a road following wheel for causing the cutter unit to follow the contour of the road, during which operation the support leg at the end of the beam is moved to an out-of-use position, and the beam can pivot freely on the bracket whilst following the road surface contour. The cutter unit can be kept in pressure engagement with the surface during this mode of operation by pressurising the pivoting ram. As an alternative, the cutter may be left to free float using its own weight, as in certain surface conditions there will be sufficient engagement of the planing unit through its own natural action.

The planing equipment according to the invention may be fitted to new vehicles, or it may be adapted to be an attachment to existing vehicles, and a particularly suitable application of the latter case concerns the adaptation of the equipment as an attachment to a standard excavator. When the planing equipment is provided in such a machine, the road planing equipment could be used to cut a channel through the top surface of the roadway and thereafter, by repositioning of the planer if necessary, the bucket of the excavator could be used to dig a standard trench along the line of the cut surface.

It is conceivable that a beam of this type with the cutter unit could be mounted onto the track carriage of a tracked 360 degrees excavator so that by operating the track over the trench to be cut, the planer unit could operate and open up the road surface. Because the excavator operates above the planer unit, the normal excavating bucket operation can continue and as these are larger machines, the two operations can be carried out simultaneously, whereas with a normal, smaller wheeled type excavator, the operation of the road planer would be one function and then the machine would have to move sideways to be over the opened up trench to use its excavator bucket.

Any suitable means may be provided for moving the planar unit on the beam, although in a particular example we refer to use a fluid pressure operated ram.

An embodiment of the invention will now be described, by way of example, with reference to the accompanying drawings, wherein.

Figure 1:
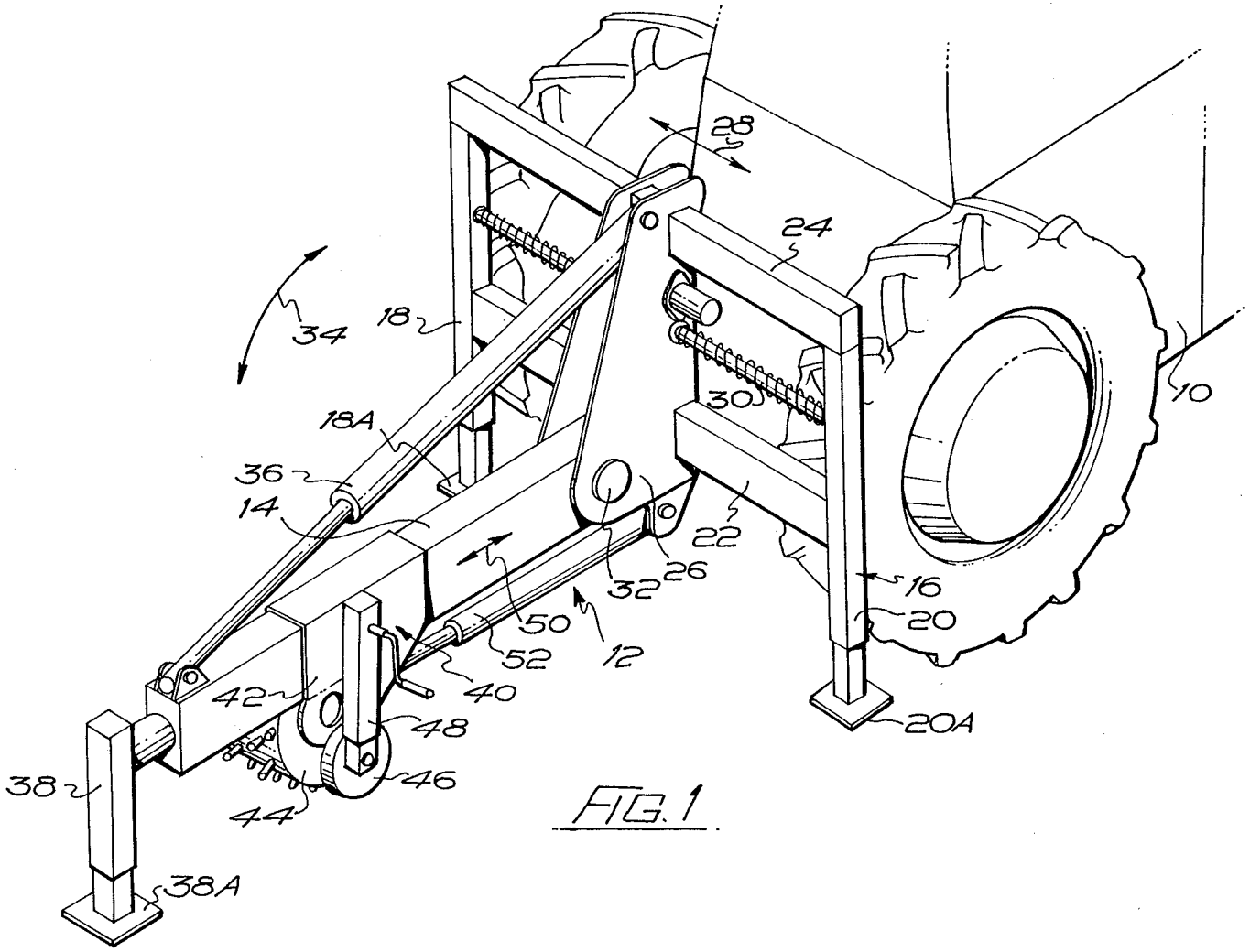
FIG. 1 is a perspective view of the equipment when attached to a tractor vehicle.

Referring to the drawings, in FIG. 1 a tractor vehicle is indicated by numeral 10, and the road planing equipment according to the invention by numeral 12. This equipment comprises a beam 14, which in use is arranged horizontally as shown, and extends rearwardly of the vehicle 10, and a support frame 16 which lies in a vertical plane extending transversely to the beam 14. The frame 16 comprises two outer legs 18, 20 which are held rigid and in spaced parallel arrangement by cross bars 22 and 24. A bracket 26 is movable on the cross bars 24, 22 in the direction of arrow 28 by means of a screw adjustment spindle 30. Other adjustment means such as fluid pressure operated rams can be used. The spindle may be rotated by a suitable power source, such as an electric motor or power take-off drive from tractor 10. The beam 14 is pivotally connected to the bracket 26 by pivot pin 32, so that the beam can swing as indicated by arrow 34 from the horizontal in-use position to an upwardly inclined position (not shown) which is the out-of-use position. In the out-of-use position, the overall length of the tractor and planing equipment is reduced. The pivoting of beam 14 is achieved by means of fluid pressure operated ram 36 which is pivotally connected to the top of bracket 26, and to the end of the beam 14 as shown.

At the outer end, the beam is provided with a support leg 38.

Each of the legs 18 and 20 of the frame 16 and the support leg 38 is telescopic and is provided with a ground engaging foot 18A, 20A and 38A respectively, and the foot can be displaced up or down by suitable telescopic means such as a mechanical jack or a fluid pressure operated ram.

Slidably carried by the beam 14 is a cutter unit 40 which comprises a bracket 42 slidable on beam 14 and a cutter drum 44 which has an appropriate cutting surface made up of cutting picks of design and construction to suit the surface to be cut. These picks are readily replaceable when worn. The drum 44 is power driven and performs the action of cutting the roadway surface. Additionally, the unit is provided with a guide wheel 46 and mechanism 48 for adjusting the height of the guide wheel 46, thereby to control the depth of cut of the drum 44 in a particular mode of operation. It is useful at this stage to refer to FIG. 3, as this fig. shows a modified method of mounting the cutter drum 44. In this modification, the drum 44 is carried by two pivot arms 43 so that it can be height adjusted by means of a fluid pressure operated ram 45. The arms 43 are pivoted at 47 on the beam slide 42 so that the cutter unit can slide on the beam 14, as in the FIG. 1 embodiment. The FIG. 3 embodiment is useful when it is desired to have fine cutting depth adjustment i.e. the beam would be set in a position roughly in the correct place to the road surface, but a final adjustment may be necessary between the beam and the cutting unit to set the depth correctly. This arrangement is desireable when the beam is mounted onto an excavator chassis as will be described in relation to FIG. 5.

In use, the feet 18A, 20A, and 38A are arranged to engage the ground, and this sets the position of the beam 14, and also the depth of cut which will be made by the cutter. To cut a strip, the unit 40 is moved along the beam 14 as indicated by the arrow 50, by means of a fluid pressure operated ram 52 coupled between bracket 26 and unit 40. To cut parallel strips, the bracket 26 is moved by means of the screw spindle 30. During the lateral stepwise movement of the beam 14, it may be desirable to raise the foot 38 clear of the ground until the beam has been moved.

Figure 2:
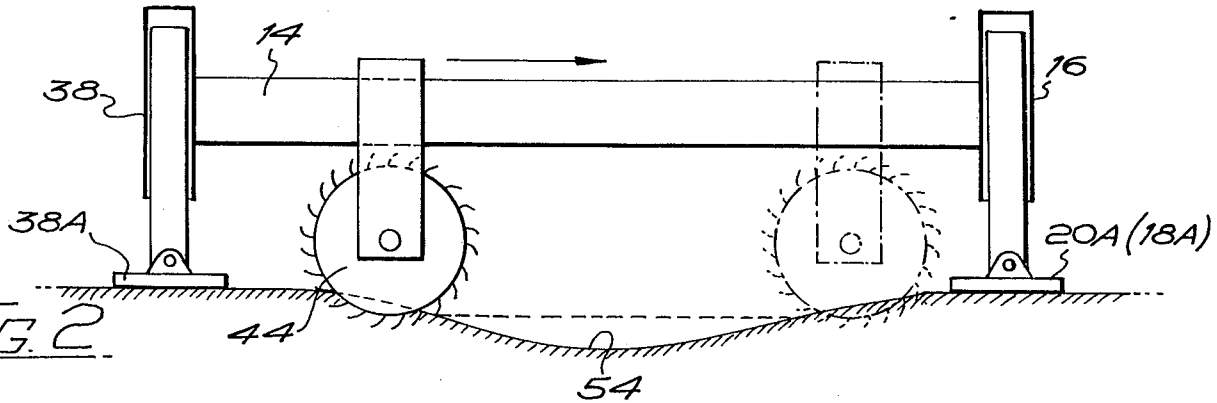
FIG. 2 is a sketch showing how the equipment can be used for cutting a road surface with recesses or potholes.

FIG. 2 shows diagrammatically how the equipment can be used for cutting the roadway surface when it has a recess or pothole 54 and moves parallel to the beam 14, and therefore if the recess 54 is deeper than the depth of cut being effected by the cutter drum 44, the bottom surface of the recess will not be cut, and this is extremely useful in that the amount of material that is actually removed from the roadway surface is reduced, and this is highly advantageous in connection with roadway surface patching work.

When it is desired that the cutter drum 44 should follow the roadway surface contour, the foot 38A is raised clear of the ground, and the guide wheel 46 is set so as to control the depth of cut by the cutter 44, and in this arrangement the arm 14 will pivot in dependence upon the ground contour, the cutter drum 44 being kept in biased engagement with the ground by means of the ram 36.

In this arrangement, with the two feet 18A and 20A engaging the ground, the cutting drum can be angled to suit the camber of the road, and this will also provide stability for the tractor when the cutting operation is taking place, although it is not strictly necessary that such feet 18A and 20A should be in contact with the ground during this operation.

The planing equipment according to the invention provides an extremely simple and effective arrangement for the cutting of roadway surfaces, and the equipment can be supplied as an attachment to existing vehicles, or can be embodied in new vehicles.

Figure 4:
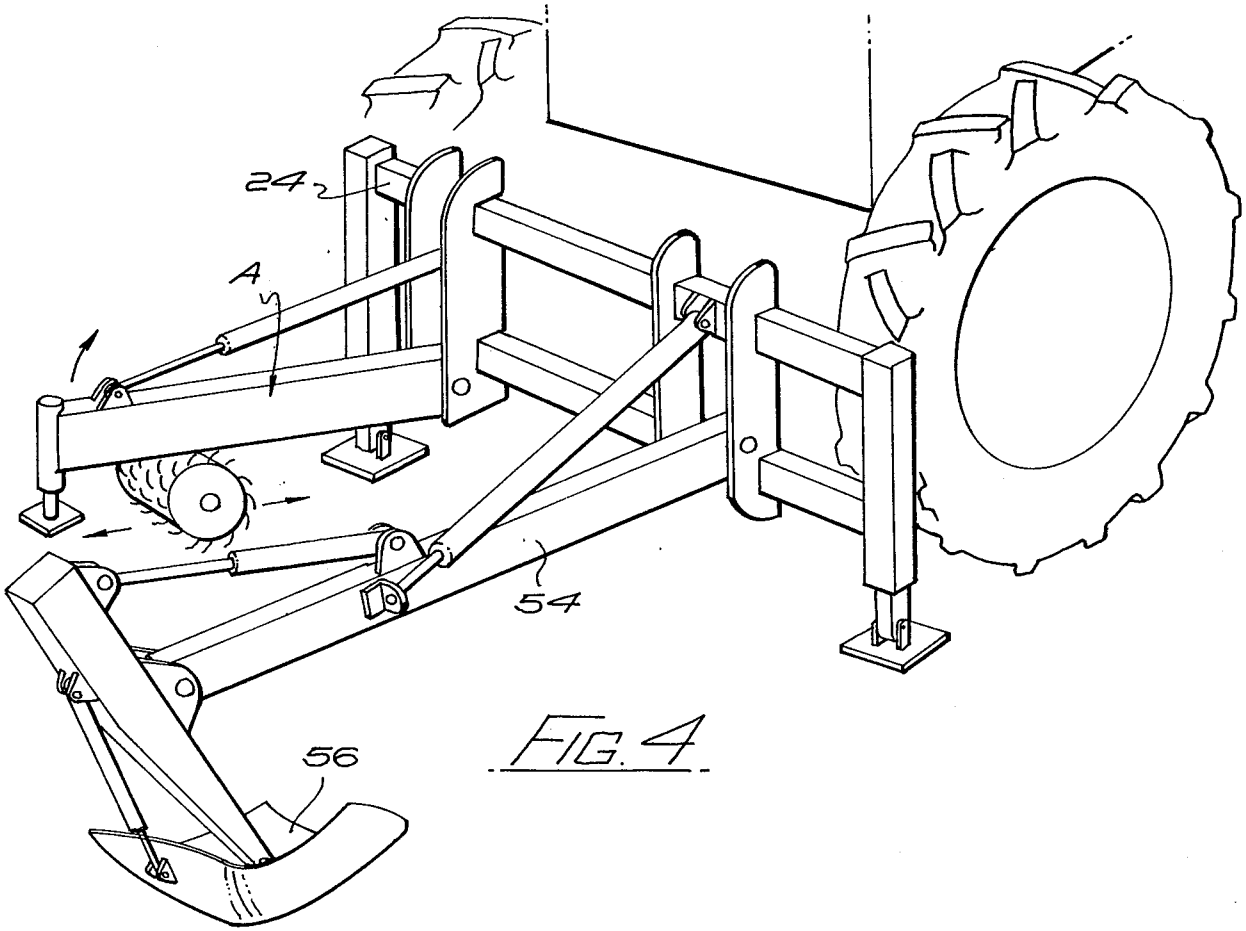
FIG. 4 is a perspective view of the rear of a standard excavator with a unit according to the invention mounted thereon in parallel with a bucket.
Figure 5:
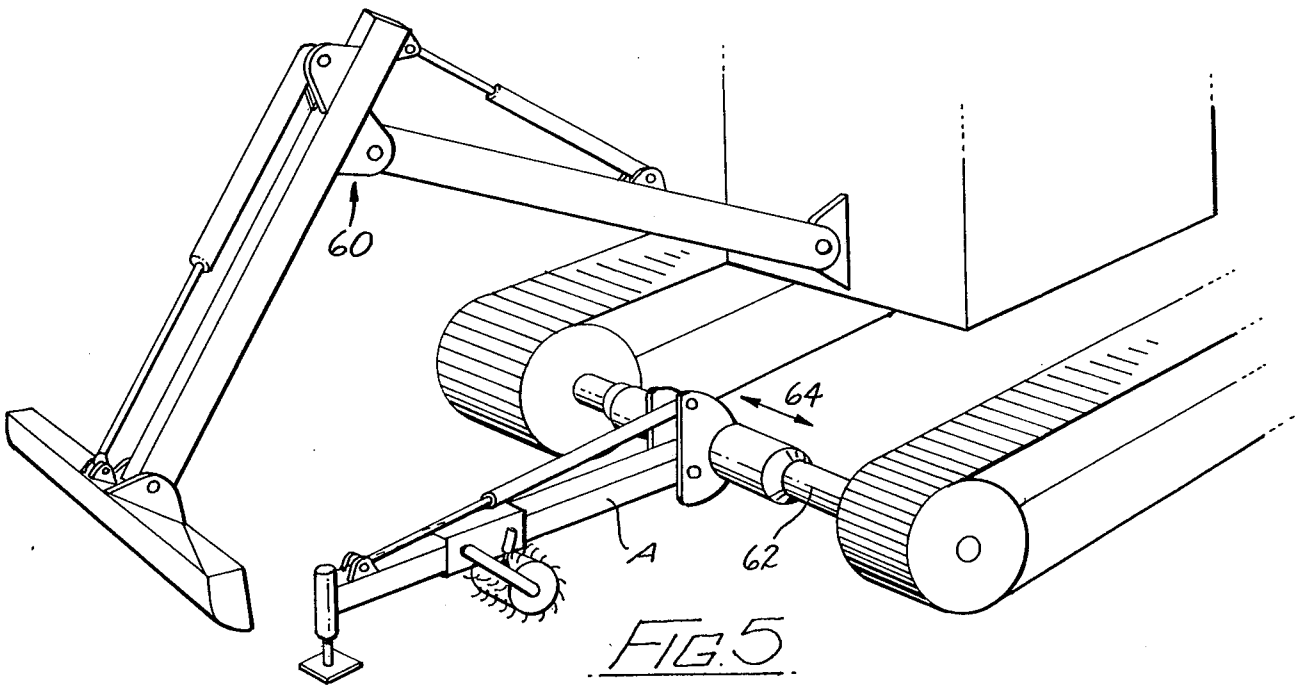
FIG. 5 is a perspective view of the rear of a tracked excavator, with a unit according to the invention mounted thereon.

FIGS. 4 and 5 show two additional mounting arrangements for a cutting unit according to the invention.

In FIG. 4, the rear of a vehicle on which the unit according to the invention is mounted is shown. The unit A according to the invention is shown as being slideable on the frame 24, and operates as described, but in addition, there is also mounted on the frame so as to be slideable thereon, a standard excavating arm 54 with excavator bucket 56. The unit A and the excavator arm 56 and bucket 54 can be operated at the same time when orerating on different parts of the road surface, or in sequence when they are to operate on the same section of the road surface.

In the FIG. 5 arrangement the unit A according to the invention is mounted as shown at the rear of a tracked vehicle having an excavator arm and bucket arrangement 60. In this case the unit is slideable on the axle 62 of the vehicle in the direction indicated by the arrow 64, but the advantage of this arrangement is that the unit and the excavator bucket can work in alignment in the direction of the road at the same time, with the tracks of the vehicle straddling the working line.

Figure 3:
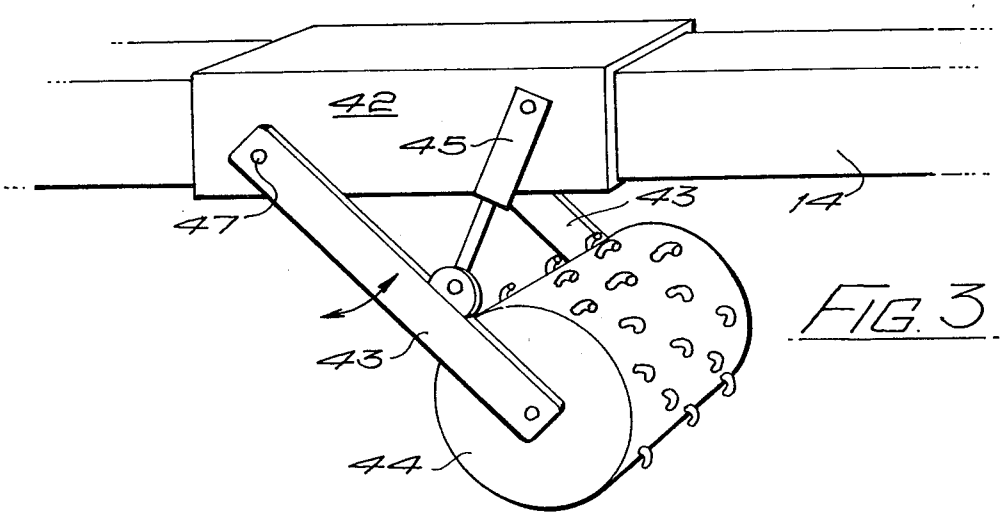
FIG. 3 is a perspective view of an alternative mounting arrangement for the cutting head on the beam.

In either the FIG. 4 or the FIG. 5 embodiment, the unit A may be constructed and may operate according to the embodiment of FIG. 1 or FIG. 3.

I claim:

1. A roadway cutting device that is supported on a wheeled roadway vehicle or which is adapted to be mounted on a wheeled roadway vehicle, said roadway cutting device comprising in combination:

(a) an elongated beam that is adapted to extend in cantilever fashion outwardly from the supporting wheels of said roadway vehicle so as to define an inner end close to the roadway vehicle and an outer end that is spaced outwardly and away from the supporting wheels of the roadway vehicle;

(b) a frame connected to the inner end of said beam, said frame being adapted to be connected to a portion of said roadway vehicle;

(c) jackable legs means on said frame which are adjustable in length, the leg means having ground engaging feet and being of variable length;

(d) a cutter unit mounted on said elongated beam so that it is able to move back and forth along said beam;

(e) means to move said cutter unit over at least a portion of the length of said elongated beam;

(f) a cutter head associated with said cutting unit which is adapted to contact a roadway surface;

(g) a support leg at the outer end of the beam for supporting the outer end of the beam so that by supporting the inner and outer ends of the beam on the leg means at the inner end of the beam and the support leg at the outer end of the beam the cutter head can be made to cut the road along a line parallel to the beam regardless of the profile of the road surface under the beam.

2. A device according to claim 1, including means connecting the inner end of the beam to the frame enabling the beam to be moved in a direction transverse to the length direction of the beam.

3. A device according to claim 2, which includes an excavator bucket which can be used to dig a trench in the ground along a line whose surface has previously been removed by said cutter head.

4. A roadway cutting device that is supported on a wheeled roadway vehicle or which is adapted to be mounted on a wheeled roadway vehicle, said roadway planing device comprising in combination:

(a) an elongated beam that is adapted to extend in cantilever fashion outwardly from the supporting wheels of said roadway vehicle so as to define an inner end close to the roadway vehicle and an outer end that is spaced outwardly and away from the supporting wheels of the roadway vehicle;

(b) mounting means connected to the inner end of said beam, said mounting means being adapted to be connected to a portion of said roadway vehicle;

(c) a cutter unit mounted on said elongated beam so that it is able to move back and forth along said beam;

(d) means to move said cutter over at least a portion of the length of said elongated beam;

(e) a cutter head associated with said cutting unit which is adapted to contact a roadway surface; and (f) an excavator bucket which is carried by the mounting means and which can be used to dig a trench in the ground along a line whose surface has previously been removed by said cutter head said excavator bucket being carried by said mounting means.

5. A roadway cutting device that is supported on a wheeled roadway vehicle or which is adapted to be mounted on a wheeled roadway vehicle, said roadway planing device comprising in combination:

(a) an elongated beam;

(b) mounting means connected to the said beam, said mounting means being adapted to be connected to a portion of said roadway vehicle;

(c) a cutter unit mounted on said elongated beam so that it is able to move back and forth along said beam;

(d) means to move said cutter unit over at least a portion of the length of said elongated beam;

(e) a cutter head associated with said cutting unit which is adapted to contact a roadway surface;

(f) means for raising and lowering the beam relative to the vehicle between an operative position in which the cutter head is adapted to contact the roadway surface and a raised transport position in which the device is supported by the vehicle and can be transported thereby; and (g) leg means at each end of the beam adapted to engage the ground to support the beam stably in the operative position controlling the extent to which the cutting head cuts the road surface when it moves along the beam.

6. A device according to claim 5, wherein said leg means are of adjustable length to support the beam above the ground at different heights.

7. A device according to claim 5, wherein said leg means include fluid pressure operated rams for the adjustment of the length thereof.

8. A device according to claim 1 wherein said beam is mounted on said frame by means of a bracket which can be displaced in a direction transverse to the length of the beam, whereby the position of the beam laterally of its length may be altered, and whereby the cutter head can be operated to remove an area of roadway surface by the combined movement of the cutter head longitudinally along the beam and by movement of the beam transversely of its length.

9. A device according to claim 8 wherein the support leg at the outer end of the beam is of variable length and has a ground engaging foot, so that by causing the beam to be supported by the leg means of the frame and the support leg at the outer end of the beam, the cutter head will travel in a predetermined path along the beam and will cut along a path parallel to the beam regardless of the profile of the road surface under the cutter head.

10. A device according to claim 8 wherein said beam is pivotally connected to said bracket, so that it can be moved between an operative substantially horizontal position, and a stored, pivoted position, in which the beam extends upwardly.

11. A device according to claim 9 wherein said beam is pivotally connected to said bracket, so that it can be moved between an operative substantially horizontal position, and a stored, pivoted position, in which the beam extends upwardly.

12. A device according to claim 10 which includes a fluid pressure operated ram for pivoting said beam.

13. A device according to claim 11 which includes a fluid pressure operated ram for pivoting said beam.

14. A device according to claim 1 wherein said cutter unit includes a road-following wheel for causing the cutter head to follow the contour of the road.

15. A device according to claim 2 wherein said cutter unit includes a road-following wheel for causing the cutter head to follow the contour of the road.

16. A device according to claim 8 which includes a fluid pressure operated ram for moving said cutter unit along the beam.

17. A device according to claim 1 which includes a fluid pressure operated ram for moving said cutter unit along the beam.

18. A device according to claim 16 which includes an excavator bucket which can be used to dig a trench in the ground along a line whose surface has previously been removed by said cutter head.

19. A device according to claim 17 which includes an excavator bucket which can be used to dig a trench in the ground along a line whose surface has previously been removed by said cutter head.

20. A device according to claim 1 wherein said cutter unit comprises a cutter head, pivot arms carrying said cutter head, a sliding housing slidable on the beam and to which said pivot arms are pivotally connected and a fluid pressure ram acting between the pivot arms and the housing for urging the cutter head into engagement with the ground.

21. A device according to claim 4 wherein said cutter unit comprises a cutter head, pivot arms carrying said cutter head, a sliding housing slidable on the beam and to which said pivot arms are pivotally connected and a fluid pressure ram acting between the pivot arms and the housing for urging the cutter head into engagement with the ground.

22. A roadway cutting device that is supported on a wheeled roadway vehicle or which is adapted to be mounted on a wheeled roadway vehicle, said roadway cutting device comprising in combination:

(a) an elongated beam that is adapted to extend in cantilever fashion outwardly from the supporting wheels of said roadway vehicle so as to define an inner end close to the roadway vehicle and an outer end that is spaced outwardly and away from the supporting wheels of the roadway vehicle;

(b) a frame connected to the inner end of said beam, said frame being adapted to be connected to a portion of said roadway vehicle, (c) jackable legs means on said frame which are adjustable in length, the leg means having ground engaging feet and being of variable length, (d) a cutter unit mounted on said elongated beam so that it is able to move back and forth along said beam, (e) means to move said cutter unit over at least a portion of the length of said elongated beam, (f) a cutter head associated with said cutting unit which is adapted to contact a roadway surface, and (g) a road following wheel on the cutter unit providing additional support for the beam and for controlling the depth to which the cutter can penetrate the road surface.

* * * * *